US011383135B2

(12) United States Patent
Oliver

(10) Patent No.: US 11,383,135 B2
(45) Date of Patent: Jul. 12, 2022

(54) PORTABLE TRAINING SYSTEM

(71) Applicant: Paul Oliver, Dallas, TX (US)

(72) Inventor: Paul Oliver, Dallas, TX (US)

( * ) Notice: Subject to any disclaimer, the term of this patent is extended or adjusted under 35 U.S.C. 154(b) by 0 days.

(21) Appl. No.: 16/158,820

(22) Filed: Oct. 12, 2018

(65) Prior Publication Data

US 2019/0111319 A1 Apr. 18, 2019

Related U.S. Application Data

(60) Provisional application No. 62/571,488, filed on Oct. 12, 2017.

(51) Int. Cl.

| | |
|---|---|
| ***A63B 26/00*** | (2006.01) |
| ***A63B 17/00*** | (2006.01) |
| ***A63B 17/04*** | (2006.01) |
| ***A63B 69/00*** | (2006.01) |
| ***A63B 9/00*** | (2006.01) |
| ***A63B 71/06*** | (2006.01) |

(52) U.S. Cl.

CPC ..... *A63B 26/00* (2013.01); *A63B 9/00* (2013.01); *A63B 17/00* (2013.01); *A63B 17/04* (2013.01); *A63B 69/0028* (2013.01); *A63B 2071/0694* (2013.01); *A63B 2210/50* (2013.01); *A63B 2225/62* (2013.01)

(58) Field of Classification Search

CPC ..... A63B 26/00; A63B 9/00; A63B 69/0028; A63B 17/04; A63B 17/00; A63B 2071/0694; A63B 2210/50; A63B 2225/62

See application file for complete search history.

(56) References Cited

U.S. PATENT DOCUMENTS

| | | | | |
|---|---|---|---|---|
| 4,709,929 | A * | 12/1987 | Mills | A63B 63/08 273/402 |
| 6,190,222 | B1 * | 2/2001 | Senger | B63C 9/32 441/82 |
| 6,322,454 | B1 * | 11/2001 | Gordon | A63B 69/0048 472/134 |
| 6,558,264 | B2 * | 5/2003 | Gordon | A63G 21/18 472/117 |
| 6,565,405 | B2 * | 5/2003 | Hsu | A63B 5/11 446/220 |
| 6,648,767 | B1 * | 11/2003 | Chen | A63G 21/18 472/117 |
| 7,300,354 | B2 * | 11/2007 | Field | A63G 31/12 472/117 |
| 7,309,302 | B1 * | 12/2007 | Phillips | A63B 69/18 482/35 |
| 7,789,761 | B1 * | 9/2010 | Lumsden | A63G 21/02 472/116 |
| 7,789,804 | B1 * | 9/2010 | Phillips | A63B 69/18 482/35 |

(Continued)

*Primary Examiner* — Garrett K Atkinson

(74) *Attorney, Agent, or Firm* — Leavitt Eldredge Law Firm

(57) ABSTRACT

A portable training system enables the deployment of customizable training equipment. The system has an inclined surface over which users move to provide and increased work out. Additional equipment such as ropes or elastic bands are able to be attached to the side to broaden the exercises available to the users. The system incorporates marks for targeted movement and coordination of the work out.

1 Claim, 4 Drawing Sheets

(56) References Cited

U.S. PATENT DOCUMENTS

| | | | | |
|---|---|---|---|---|
| 7,878,877 | B2 * | 2/2011 | Scherba | A63G 9/00 446/220 |
| 7,896,779 | B1 * | 3/2011 | Phillips | A63B 5/11 482/51 |
| D717,899 | S * | 11/2014 | Chen | D21/797 |
| 9,061,215 | B2 * | 6/2015 | Scherba | A63G 31/12 |
| 9,463,390 | B2 * | 10/2016 | Vicente | A63G 21/18 |
| 9,913,767 | B2 * | 3/2018 | Olivo | A61G 7/103 |
| 10,071,318 | B1 * | 9/2018 | Bagumyan | A63G 21/18 |
| 10,744,417 | B2 * | 8/2020 | Myrman | A63G 31/007 |
| 11,090,573 | B2 * | 8/2021 | Myrman | A63G 21/18 |
| 2003/0003840 | A1 * | 1/2003 | Hsu | A63H 33/008 446/221 |
| 2007/0072690 | A1 * | 3/2007 | Berenson | A63G 21/18 472/117 |
| 2007/0167246 | A1 * | 7/2007 | McKee | A63G 31/007 472/116 |
| 2009/0137330 | A1 * | 5/2009 | Sefchick | A63G 31/007 472/117 |
| 2009/0149111 | A1 * | 6/2009 | Scherba | G09B 25/04 446/220 |
| 2010/0203494 | A1 * | 8/2010 | Scherba | A63G 9/00 434/365 |
| 2015/0119155 | A1 * | 4/2015 | Vicente | A63G 31/007 472/128 |
| 2015/0121634 | A1 * | 5/2015 | Anastasia | B63B 35/00 14/69.5 |
| 2017/0000667 | A1 * | 1/2017 | Olivo | A61G 1/013 |
| 2017/0136373 | A1 * | 5/2017 | Vicente | A63B 69/0093 |
| 2019/0046887 | A1 * | 2/2019 | Vicente | A63G 31/12 |

* cited by examiner

PORTABLE TRAINING SYSTEM

BACKGROUND

1. Field of the Invention

The present invention relates generally to exercise equipment, and more specifically, to a portable training system for allowing for the transport of exercise implements to a location for temporary use.

2. Description of Related Art

Exercise equipment is well known in the art and are effective means to augment a physical training regimen. For example, FIG. 1 depicts a conventional gym floor 101 having a floor 103 with markings 105 and 107. During use, individuals run from mark 105 to mark 107.

One of the problems commonly associated with gym floor 101 is its limited use. For example, the floor is in a fixed place and provides a defined set of available exercises.

Accordingly, although great strides have been made in the area of exercise equipment, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
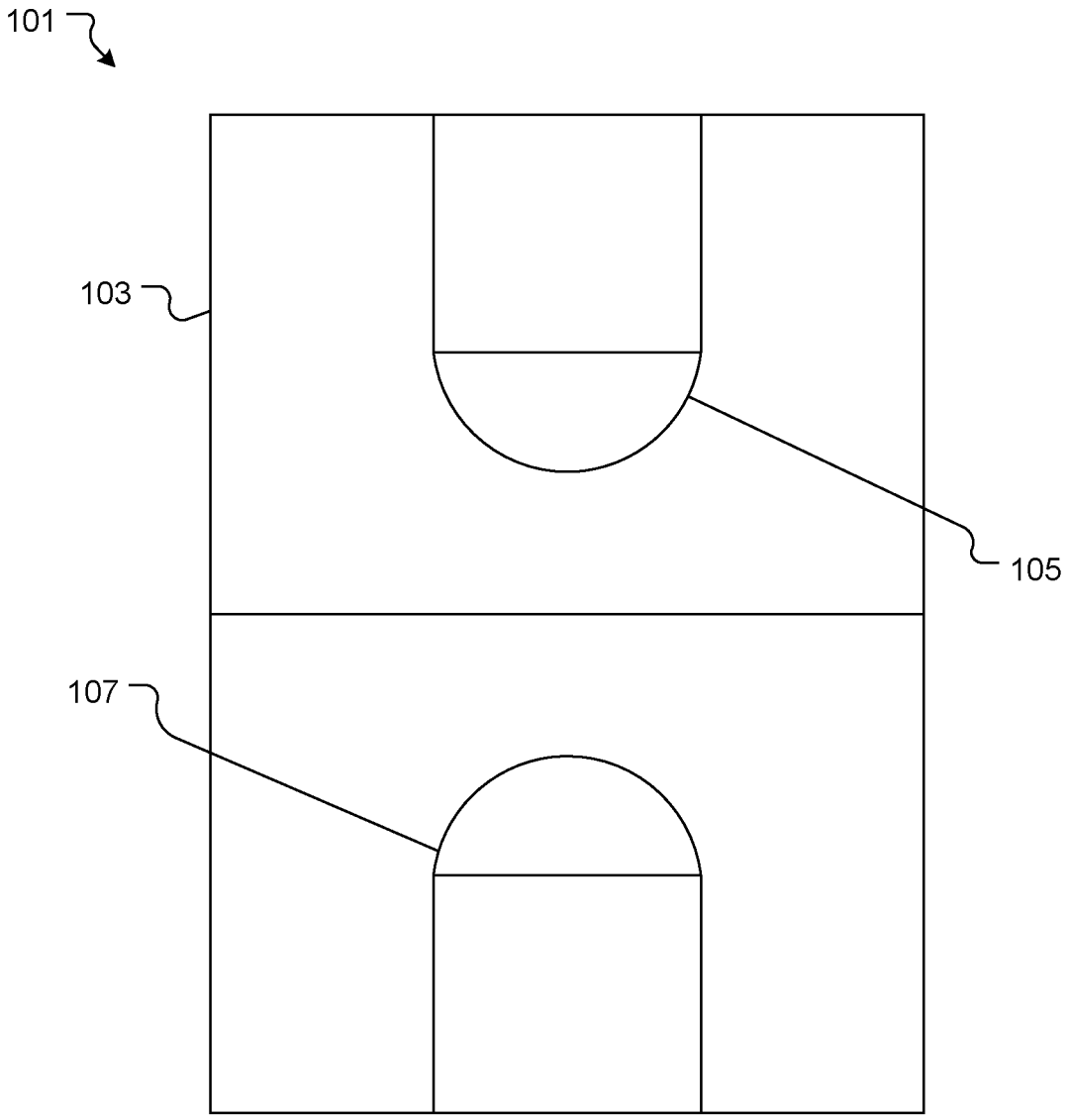
FIG. 1 (Prior Art)
FIG. 1 is a top view of a common gym floor.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise equipment. Specifically, the system of the present application enables performing running exercises on an incline where non incline permanently exists. In addition, the system allows for the additional training equipment to be attached and altered to cater to the specific needs of the users. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
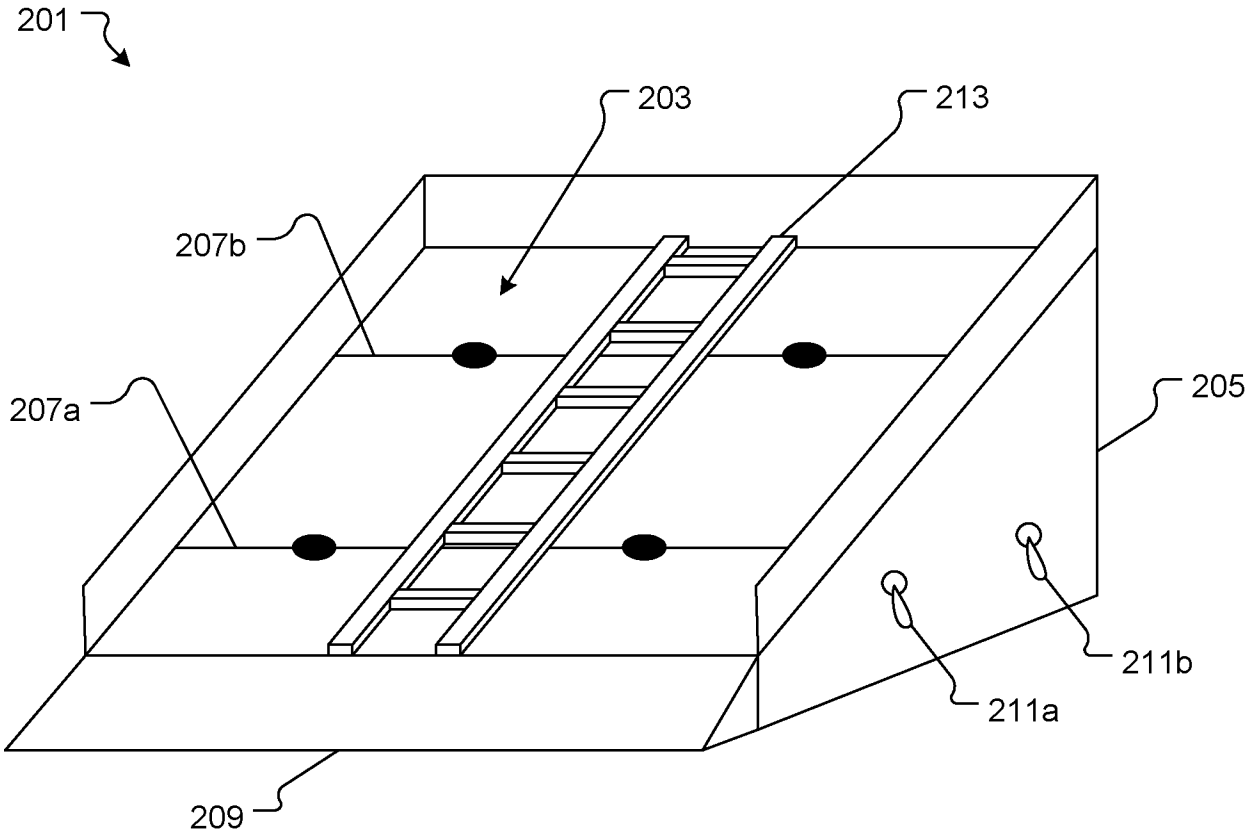
FIG. 2 is a perspective view of a portable training system in accordance with a preferred embodiment of the present application.

Referring now to the drawings wherein like reference characters identify corresponding or similar elements throughout the several views, FIG. 2 depicts a perspective view of a portable training system in accordance with a preferred embodiment of the present application. It will be appreciated that system 201 overcomes one of more of the above-listed problems commonly associated with conventional exercise equipment.

Figure 3:
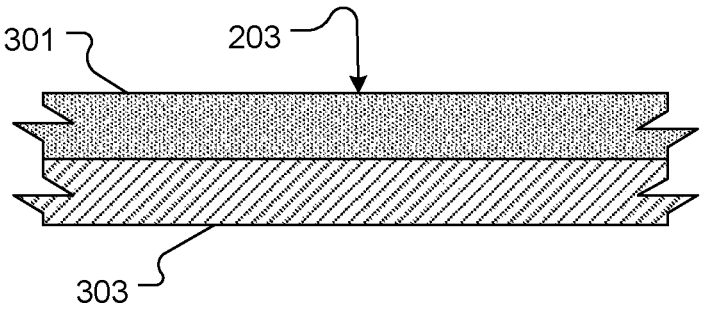
FIG. 3 is a cross-sectional side view of the ramp surface of FIG. 2.

In the contemplated embodiment, system 201 includes a ramp surface 203 supported by a bladder 205 filled with air. The surface 203 bring inclined with one edge near the ground. The surface 203 having indicia 207 separated from each other. The system 201 having a front edge 209 attached to the lower end of the bladder 205. The ramp surface 203 having a high friction coating 301 applied to the top surface 303 of the bladder 205 as depicted by FIG. 3

The bladder 205 having equipment attachment points 211 on the sides. It will be understood that equipment such as ropes, elastic bands or other equipment is attached to diversify the work out available. It is contemplated that equipment attachment points 211 could be attached to any surface of the bladder 205. The ramp surface 203 having a ladder 213 attached to facilitate climbing to the top of the ramp surface 203.

It should be appreciated that one of the unique features believed characteristic of the present application is that ramp surface 203 enables movement over the inclined surface of the bladder 205.

Another unique feature believed characteristic of the present application is that additional exercise equipment can be used via equipment attachment points 211.

Figure 4:
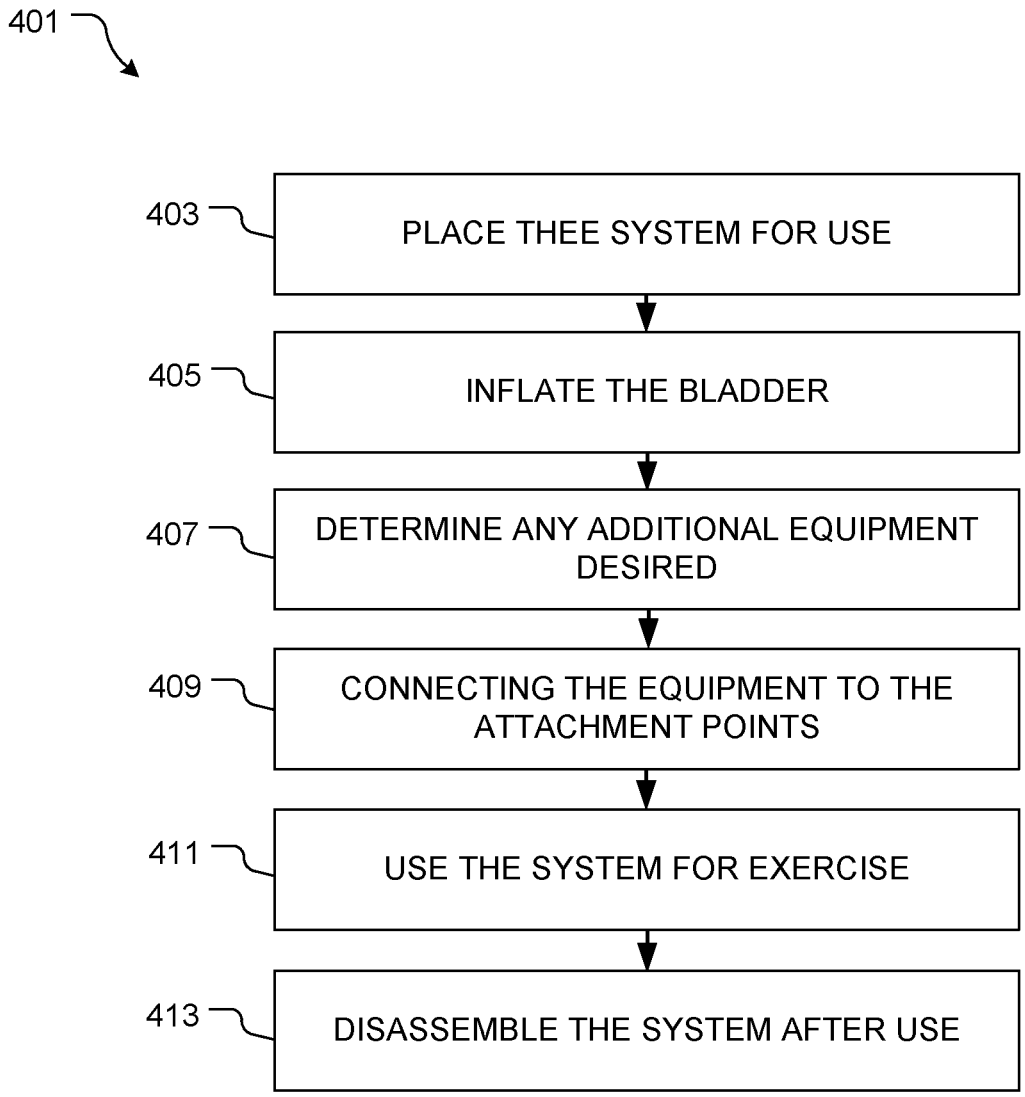
FIG. 4 is a flowchart of the preferred method of use of the system of FIG. 2.

Referring now to FIG. 4 the preferred method of use of system 201 is depicted. Method 401 includes placing the system for use 403, inflating the bladder 405, determining additional equipment desired 407, connecting the equipment to the attachment points 409, using the system for exercise 411 and disassembling the system 413.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A portable training system comprising:

a bladder fillable with a gas having a ramp surface configured to have one side near the ground and the other elevated side, the ramp having a front and a back, the ramp having a plurality of indicia on a top surface extending from the one side near the ground to the other elevated side;

a ladder secured to the top surface of the ramp;

a high friction coating applied solely to the top surface of the ramp;

a front edge attached to the front of the bladder, the front edge is removably attached to the front of the bladder; and at least one equipment attachment point attached to a side of the bladder, the at least one equipment attachment point is configured to releasably secure to an exercise equipment device.

* * * * *